United States Patent [19]

Jablin

[11] 4,066,513

[45] Jan. 3, 1978

[54] COKE QUENCHING STEAM GENERATOR

[76] Inventor: Richard Jablin, 1438 Manor Lane, Blue Bell, Pa. 19422

[21] Appl. No.: 674,299

[22] Filed: Apr. 6, 1976

[51] Int. Cl.[2] ..... C10B 39/04

[52] U.S. Cl. ..... 201/39; 202/227

[58] Field of Search ..... 201/39; 202/227, 228, 202/241

[56] References Cited

U.S. PATENT DOCUMENTS

| | | | |
|---|---|---|---|
| 958,184 | 5/1910 | Schulte | 201/39 |
| 1,457,713 | 6/1923 | Moetteli | 201/39 |
| 2,975,106 | 3/1961 | Becker | 202/227 X |
| 3,790,448 | 2/1974 | Didycz et al. | 201/39 |
| 3,892,250 | 7/1975 | Miko | 202/241 X |
| 3,959,084 | 5/1976 | Price | 201/39 |

FOREIGN PATENT DOCUMENTS

| | | |
|---|---|---|
| 2,407,689 | 8/1975 | Germany. |
| 2,120,305 | 11/1972 | Germany. |
| 329,751 | 5/1930 | United Kingdom. |

*Primary Examiner*—Joseph Scovronek
*Assistant Examiner*—Arnold Turk
*Attorney, Agent, or Firm*—Finnegan, Henderson, Farabow & Garrett

[57] ABSTRACT

A coke quenching steam generator comprising a vertical, refractory-lined pressure vessel for quenching of incandescent coke and producing useful steam from the sensible heat in the coke. Included in the pressure vessel are pressure-tight doors for receiving and discharging the coke, water sprays for quenching the coke, a hopper for receiving the coke and a gate and feeder for controlling the discharge of the quenched coke. External to the pressure vessel are a crane for lifting containers of incandescent coke to the receiving hopper of the pressure vessel, valves for controlling the flow of steam and water, a high efficiency cyclone for cleaning the steam, a belt conveyor for receiving the quenched coke, pumps, water storage tank, piping and controls.

13 Claims, 1 Drawing Figure

COKE QUENCHING STEAM GENERATOR

DISCLOSURE OF INVENTION

Figure 1:
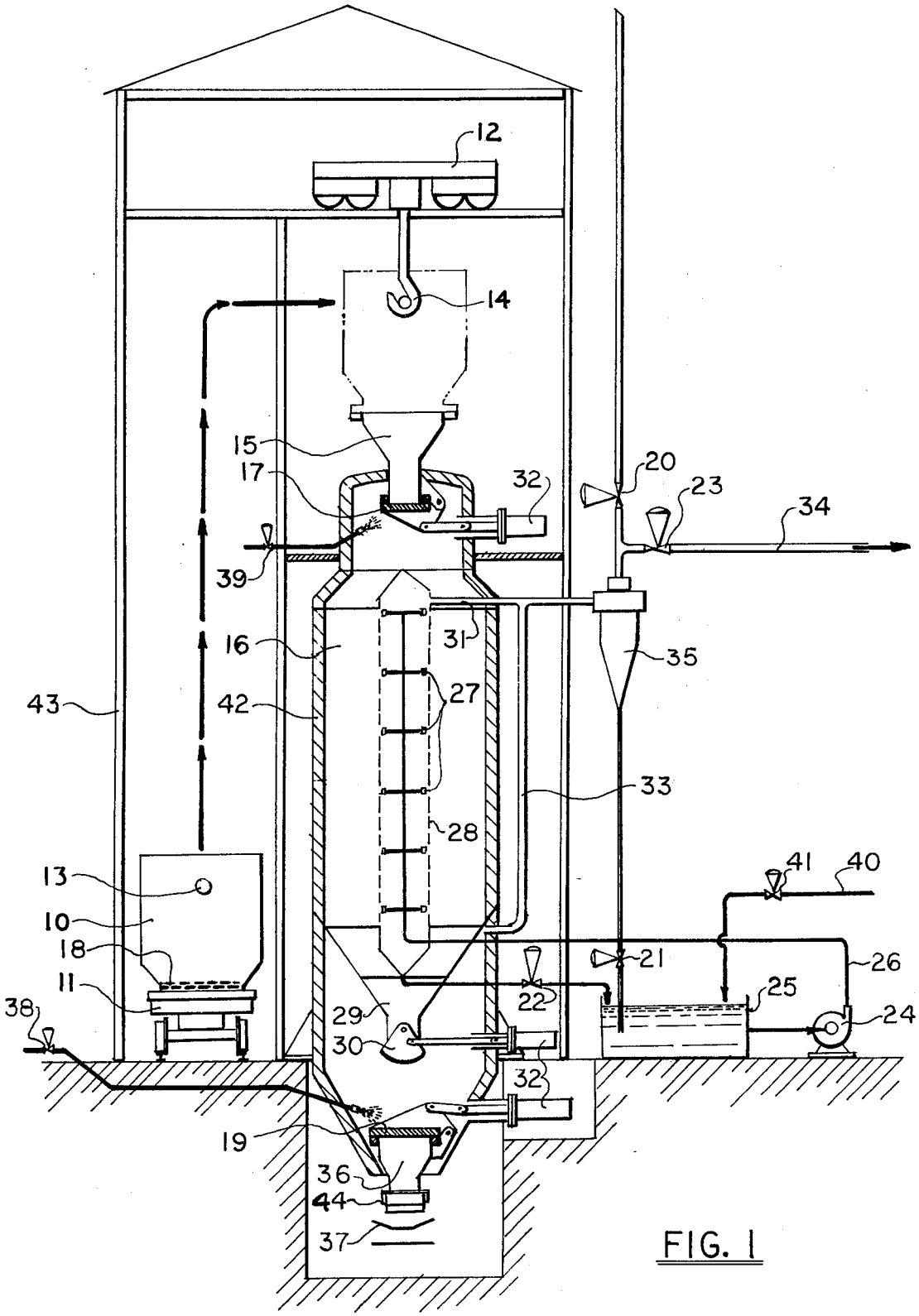

The present invention relates to a coke quenching steam generator for producing useful steam from the quenching of incandescent coke. Existing coke quenchers do not produce useful steam, because they operate in the open atmosphere and the steam that evolves from the quenching operation is wasted. In addition, air pollution results from the cloud of particulate matter which is carried off with the steam.

A purpose of this invention is to produce useful steam from the sensible heat of the incandescent coke.

A further purpose of this invention is to quench incandescent coke in a sealed pressure vessel such that the steam which arises from the quenching operation may be drawn off at a pressure which is elevated above atmospheric pressure.

A further purpose of this invention is to remove the particulate matter from the steam which evolves from the quenching of incandescent coke so that said steam may be utilized in a useful manner, or may be discharged to the atmosphere without creating air pollution.

A further purpose of this invention is to provide pressure-tight doors for receiving the incandescent coke and discharging the quenched coke such that the steam which is under elevated pressure may be contained within the pressure vessel.

A further purpose of this invention is to provide an insulating refractory lining for the pressure vessel so as to protect said pressure vessel from attack by the abrasive, incandescent coke and such as to minimize the loss of sensible heat from said pressure vessel.

A further purpose of this invention is to provide valves and controls for controlling the quenching process including stopping said process when the coke is at the desired physical condition and for relieving the pressure in the pressure vessel such that the receiving and discharge doors of said pressure vessel may be opened to discharge the quenched coke and initiate a new cycle of coke quenching. A further purpose of this invention is to arrange the receiving and discharge doors of said pressure vessel such that the sealing surfaces of said doors are protected from impingement by the coke and such that said surfaces are cleaned before said doors are reclosed.

In the drawings, I have chosen to illustrate one of the numerous embodiments in which the invention may appear, selecting the forms shown from the standpoints of convenience in illustration, satisfactory operation and clear demonstration of the principles involved.

FIG. 1 is an elevation of the coke quenching steam generator in which the pressure vessel and the water reservoir are shown in section.

In the prior art, incandescent coke is pushed from the coke ovens into a special railroad car, called a quench car. Said quench car carries the incandescent coke into a quench tower where sprays of water quench the coke so as to prevent its continued ignition. Steam, which arises from the quenching operation, travels upward into the tower and discharges through the outlet of said tower into the atmosphere. The steam carries with it particles of coke resulting in air pollution. In some installations, said towers may be equipped with baffles. The purpose of said baffles is to remove the particles of coke from said steam before the steam is discharged to the atmosphere. The baffles are inefficient and the reduction in air pollution which they achieve is not significant.

In the United States, approximately 66,000,000 tons of coke are produced during a high production year. The sensible heat that is normally wasted to the atmosphere in quenching the incandescent coke is $500 \times 10^{12}$ BTU annually, equivalent to approximately 12 million barrels of oil annually. Atmosphere quenching of incandescent coke also results in air pollution.

I have discovered a new process for quenching of incandescent coke for coke ovens which removes the sensible heat of the incandescent coke in the form of steam at a pressure which is elevated above atmospheric pressure such that said steam can be usefully consumed. In said process, said incandescent coke is placed into a sealed pressure vessel and sprayed with water. The steam which is evolved from the quenching operation, being contained within said pressure vessel, rises to a pre-determined, useful pressure before it is released from said pressure vessel.

Considering the drawing of FIG. 1, the incandescent coke is delivered to the coke quenching steam generator in container 10 by means of railroad car 11. Crane 12 engages trunnions 13 on said container by means of crane hooks 14, lifts said container in the path which is designated by the arrows and places said container on the receiving hopper 15 of the pressure vessel 16. Receiving door 17, located at the bottom of said hopper, is opened and discharge gate 18, located at the bottom of said container is also opened, permitting said incandescent coke to fall from said container into said pressure vessel. After closing the receiving door 17 and the discharge gate 18, the container 10 may be lowered by crane 12 onto railroad car 11 for return to the coke ovens in a condition which is ready for receiving a new batch of incandescent coke. Depending on the size of the coke ovens in the coke battery, one or more of said containers may be used such that the total capacity of said containers is adequate for holding the amount of coke which is pushed from an oven.

The next step is to place the pressure vessel 16 in the condition for quenching the incandescent coke. To do this, the following are closed: the receiving door 17, the discharge door 19, the steam vent valve 20, the dust valve 21 and the drain valve 22. The steam discharge valve 23 is then opened and pump 24 is started drawing water from reservoir 25 and delivering said water through pipe 26 to spray nozzles 27, thereby initiating the process of quenching the incandescent coke.

During said quenching process, the coke is contained by the pressure vessel 16, the inner cylinder 28, the intermediate hopper 29 and the discharge gate 30 which is located at the bottom of said intermediate hopper. The inner cylinder 28 is perforated such as to permit the water sprays to be delivered radially outward from the spray nozzles 27 onto the incandescent coke and to permit the steam which evolves from quenching the incandescent coke to pass radially inward into the interior of said inner cylinder and from thence to outlet steam pipe 31. The receiving door 17, the discharge gate 30 and the discharge door 19 are hinged and fitted with power cylinders 32 to permit their remote operation. All valves are fitted with power units to permit their remote operation. The receiving door 17 and the discharge door 19 are fitted with gaskets to prevent leakage of steam through said doors when they are in the closed position.

The steam which evolves during the quenching of the incandescent coke fills the pressure vessel and causes a rise in pressure. The pressure above and below the intermediate hopper is equalized by virtue of equalizer pipe 33; thus, there is no leakage of steam through the discharge gate 30 and there is no need to seal said gate against leakage of steam. When the steam pressure has reached the desired level, the steam discharge valve 23 is opened, thereby permitting the steam to flow through steam delivery pipe 34 to the point of use. In going from the steam outlet pipe 31 to the steam delivery pipe, the steam passes through the high efficiency cyclone 35 which removes the major portion of the particulate matter.

Any spray droplets which are trapped within the inner cylinder 28 fall to the bottom of said cylinder. Drain valve 22 opens automatically as the level of water rises in the bottom of said cylinder thereby draining the water back to reservoir 25.

When the coke has been cooled by quenching to the desired temperature, pump 24 is shut down, thereby halting the quenching process and the evolution of steam. The steam discharge valve 23 is then closed and the steam vent valve 20 is opened, which action releases the pressure in the pressure vessel 16. When said pressure drops to approximately atmospheric pressure the receiving door 17 and the discharge door 19 are opened. Next, discharge gate 30 is opened allowing the quenched coke to drop through funnel 36 onto feeder 44 and then onto delivery conveyor 37. After all coke has left the pressure vessel, water valves 38 and 39 are opened for a measured period of time such as to deliver water sprays against the sealing surfaces of the receiving door 17 and the discharge door 19 as well as the mating seats for said doors. The purpose of the sprays is to clean said surfaces and thereby insure leak-free joints when said doors are closed. While said cleaning is in progress, dust valve 21 is opened for a measured period of time allowing dust to fall from the cyclone 35 to the reservior 25. Periodically, said reservoir is cleaned of the accumulated dust. When said cleaning is completed, the following are closed: the discharge door 19, the discharge gate 30, the steam vent valve 20 and the dust valve 21. The pressure vessel is now ready for the next cycle of quenching as described heretofore.

The reservoir 25 is used to contain water for quenching the coke. The level of water is automatically maintained by a supply of water through pipe 40 and level control valve 41. As steam is produced, the water level drops in said reservoir and said valve opens to replace the deficit. Specially treated water is not necessary as in conventional steam generators because the water does not flow through heat-exchange surfaces and any impurities in the water will not be detrimental.

The pressure vessel 16 is lined with insulating refractory 42. The purpose of said refractory is to protect said pressure vessel against the heat and abrasion of the incandescent coke and to minimize the loss of heat from said pressure vessel.

The coke quenching steam generator is housed in structure 43 which supports crane 12. It is readily seen that the output of steam from a single coke quenching steam generator will be cyclical; steam generation will cease during that part of the cycle when water is not delivered to sprays 27 and when pressure is relieved from the pressure vessel 16. In some installations, this may be acceptable. When such variations may not be permitted, two or more of said steam generators are provided together with suitable controls of water flow and and other variables such as to produce an essentially uniform output of total steam from the several steam generators. Various commercially available operating controls and instruments may be utilized as desired and appropriate to the service.

The purpose of the invention may be served by various alternatives to those described and illustrated. For example, as an alternative to the high efficiency cyclone 35, other cleaning devices may be substituted, one such being an electrostatic precipitator. As an alternative to the drain valve 22, a steam trap may be substituted. As an alternative to the hinged receiving door 17 and discharge door 19, both of said doors may be of the sliding type. In view of my invention and disclosure, variations and modifications to meet individual whim or particular need will doubtless become evident to those skilled in the art, to obtain all or part of the benefits of my invention without copying the apparatus or process shown, and I therefore claim all such insofar as they fall within the reasonable spirit and scope of my claims.

Having thus described my invention, what I claim as new and desire to secure by Letters Patent is:

1. A batch process for quenching incandescent coke and producing steam at superatmospheric pressure, comprising:

a. feeding the coke into the top of a vertically disposed pressure vessel to substantially fill said vessel with a stationary batch of coke;

b. sealing said vessel sufficiently to contain steam at superatmospheric pressure;

c. spraying water radially outwardly into said batch of coke through a plurality of nozzles disposed within and surrounded by said batch of coke to directly quench said coke and produce steam;

d. when said steam has reached a predetermined level of superatmospheric pressure, opening a steam discharge valve and delivering steam from said vessel through said valve at superatmospheric pressure;

e. when said quenched coke has fallen to a predetermined temperature, discontinuing said spraying, closing said steam discharge valve, and opening a steam vent valve to release the pressure in said vessel; and f. after the pressure in said vessel has fallen to approximately atmospheric pressure, discharging said batch of coke through the bottom of said vessel.

2. The process of claim 1, wherein step (c) comprises spraying said water from a plurality of vertically disposed nozzles through a perforated inner cylinder disposed within said batch of coke, and wherein said steam at superatmospheric pressure that evolves from quenching said coke passes radially inwardly into the interior of said inner cylinder and then into an outlet steam pipe connected to said steam discharge valve.

3. The process of claim 2, further comprising supporting said batch of coke during quenching on an intermediate hopper disposed above the bottom of said vessel, and equalizing the pressure in said vessel above and below said intermediate hopper.

4. The process of claim 2, further comprising removing particulate matter from said superatmospheric steam after said steam has been discharged from said vessel.

5. The process of claim 2, further comprising draining any spray droplets trapped within said inner cylinder from the bottom of said inner cylinder through a drain valve, said drain valve opening automatically when the level of water in the bottom of said inner cylinder rises to a predetermined level.

6. The process of claim 2, further comprising providing a plurality of pressure vessels and operating said vessels on overlapping cycles to produce an essentially uniform output of steam at superatmospheric pressure.

7. A coke-quenching superatmospheric steam generator apparatus comprising:

a. a vertically disposed pressure vessel having a receiving gate at its top for receiving incandescent coke and a discharge gate at its bottom for discharging quenched coke;

b. means for sealing said gates sufficiently to contain steam at superatmospheric pressure;

c. a plurality of spraying nozzle means centrally disposed within said vessel to spray water radially outwardly into coke contained in said vessel;

d. an outlet steam pipe extending from the inside of said vessel to outside of said vessel, and steam discharge valve means on said pipe to open and deliver steam from said vessel when said steam has reached a predetermined level of superatmospheric pressure; and e. steam vent valve means for releasing pressure in said vessel after coke contained in said vessel has been quenched.

8. The generator apparatus of claim 7, wherein said plurality of spraying nozzle means comprise a plurality of vertically disposed nozzles, said generator apparatus further comprising a perforated inner cylinder means surrounding said nozzles and disposed within said vessel to prevent contact between said nozzles and coke contained in said vessel, and wherein said outlet steam pipe extends from the interior of said inner cylinder.

9. The generator apparatus of claim 8, further comprising means for removing particulate matter fromm superatmospheric steam that has been discharged from said vessel.

10. The generator apparatus of claim 8, further comprising drain valve means for draining water trapped within said inner cylinder and means for opening said drain valve means automatically when the level of water in the bottom of said inner cylinder rises to a predetermined level.

11. The generator apparatus of claim 8, further comprising a plurality of pressure vessels and means to operate said vessels on overlapping cycles to produce an essentially uniform output of steam at superatmospheric pressure.

12. The generator apparatus of claim 8, further comprising intermediate hopper means disposed within said vessel above said discharge gate to support coke contained in said vessel during quenching out of contact with said discharge gate, and means for equalizing the pressure in said vessel above and below said intermediate hopper.

13. The generator apparatus of claim 12, further comprising a plurality of water spray means for cleaning said means for sealing said receiving gate and said discharge gate.

* * * * *